United States Patent [19]

Ache et al.

[11] 4,217,937

[45] Aug. 19, 1980

[54] COIL WINDING MACHINE

[75] Inventors: Richard P. Ache, Bechtelsville; Stanley Gartner, Emporium, both of Pa.; Alexandre Nissen, Paris, France

[73] Assignee: GTE Products Corporation, Stamford, Conn.

[21] Appl. No.: 15,504

[22] Filed: Feb. 23, 1979

[51] Int. Cl.[3] ..... B21F 3/00

[52] U.S. Cl. ..... 140/92.1; 242/7.13

[58] Field of Search ..... 140/92.1, 92.2; 242/1.1 R, 1.1 A, 7.05 B, 7.05 C, 7.13

[56] References Cited

U.S. PATENT DOCUMENTS

| | | | |
|---|---|---|---|
| 2,533,506 | 12/1950 | Richard | 140/92.2 |
| 2,638,943 | 5/1953 | Bugg | 140/92.1 |
| 3,493,186 | 2/1970 | Arick | 242/1.1 R |

*Primary Examiner*—Lowell A. Larson
*Attorney, Agent, or Firm*—William H. McNeill

[57] ABSTRACT

An apparatus for winding saddle shaped coils particularly useful as deflection coils for cathode ray tubes. The apparatus can handle single or multiple strands of wire depending upon the coil design, and includes a winding pattern generator (26) connected to a winding head (28) which feeds the wire into a suitably configured mould. The winding pattern generator directs the winding head in sequential arcuate and longitudinal directions and does not stretch the wire as turns are made in the coil. This stretching or "necking down" of the wire, which occurred in prior art machines of the lathe type, caused varying electrical characteristics in the coils which presented a problem to the ultimate users.

1 Claim, 19 Drawing Figures

COIL WINDING MACHINE

TECHNICAL FIELD

This invention relates to coil winding machines and more particularly to such machines for automatically winding saddle-shaped coils which can be used as cathode ray tube deflection yokes.

BACKGROUND ART

Previous machines for winding saddle-shaped coils have been of the lathe type wherein a mould of suitable shape was rotated about an axis while the wires making up the coil were fed thereinto. In such machines the coils produced were subject to quality control problems caused by varying electrical characteristics. It has been determined that these varying electrical characteristics are caused by the wire being stretched and reduced in diameter as it is drawn around corners of the mould.

Further, such machines were difficult to control and difficult to program for different coil designs.

DISCLOSURE OF INVENTION

The invention comprises an apparatus for winding saddle shaped coils from at least one strand of wire, although coils comprised of simultaneously wound multiple strands are also contemplated.

Included are a supply of wire, a winding head to which wire from the supply is fed and a wire tensioning device which is positioned between the winding head and the wire supply. A winding pattern generator is operatively connected to the winding head for causing specific, programmed movement thereto. The pattern generator is positioned between the winding head and the tensioning device. Drive means are provided for the pattern generator. The coil itself is wound into a suitably shaped mould which is indexable into and out of position at a winding station which is operatively functional with the winding head.

The winding of saddle shaped coils at reasonable production speeds presents many design problems. Among these are the shape of the coil itself which requires both longitudinal and arcuate movement of the winding head, with a complete stop of the winding head before directional change of motion. Thus, inertia of all moving members is a force that must be considered. In the instant apparatus these problems are alleviated by the unique winding pattern generator which provides the winding head with the desired longitudinally reciprocating movement and arcuate movement from a driving means which provides substantially constant rotary movement. The mass of the winding head is also kept as low as possible; i.e., less than 40 grams.

The problem of the wire "necking down"; i.e., reducing in diameter because of stretching, is substantially alleviated by the unique movement of the winding head, which comes to a complete stop before changing direction and thus does not stretch the wire.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
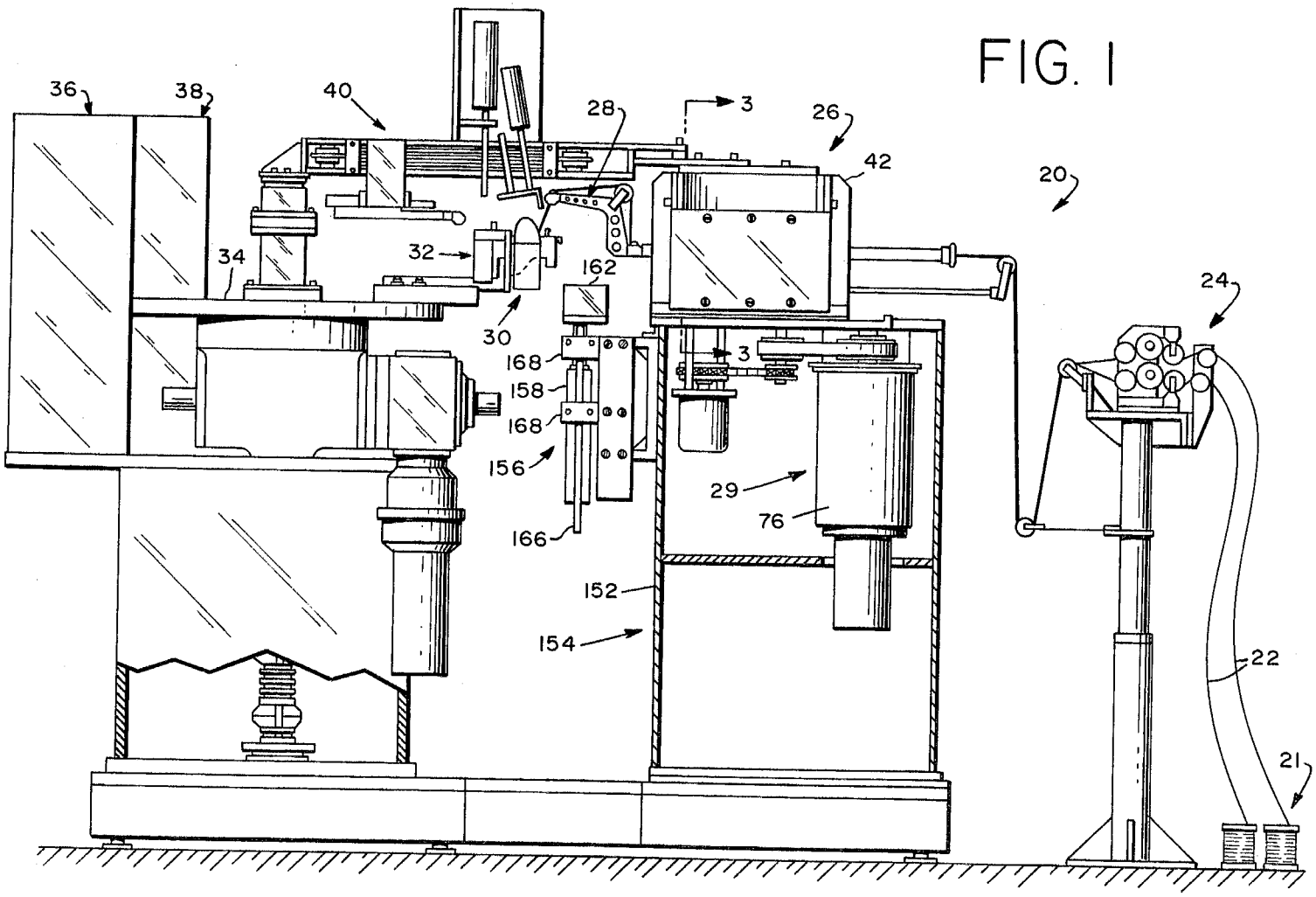
FIG. 1 is an overall elevational view of the apparatus of the invention.

Referring now to the drawings with greater particularity, there is shown in FIG. 1 an apparatus 20 for winding saddle shaped coils from at least one strand of wire. Apparatus 20 includes a supply 21 of wire 22, a wire tensioning device 24, a winding pattern generator 26, a winding head 28 driven by the winding pattern generator 26 and to which wire 22 is fed, driving means 29 for the winding pattern generator 26, and a coil mould 30 indexable into and out of position at a winding station 32 which is operatively functional with winding head 28.

The coil mould 30 is carried by an indexable rotatable turret 34. After winding at the winding station 32, coil mould 30 and its contained coil are indexed to a coil heating and compression station 36 and then to a coil checking and removal station 38. Since turret 34 carries three coil moulds, it will be seen that as one coil is being wound at the winding station 32, a priorly wound coil is being heated and compressed at station 36 while still another coil is being checked and removed at station 38. Thus, upon completion of a coil winding, an empty coil mould 30 from station 38 is available to be indexed into position at the winding station 32.

A projecting bar 40 extends from a housing 42 containing winding pattern generator 26 and carries a plurality of clamps whose function will be explained hereinafter.

Figure 3:
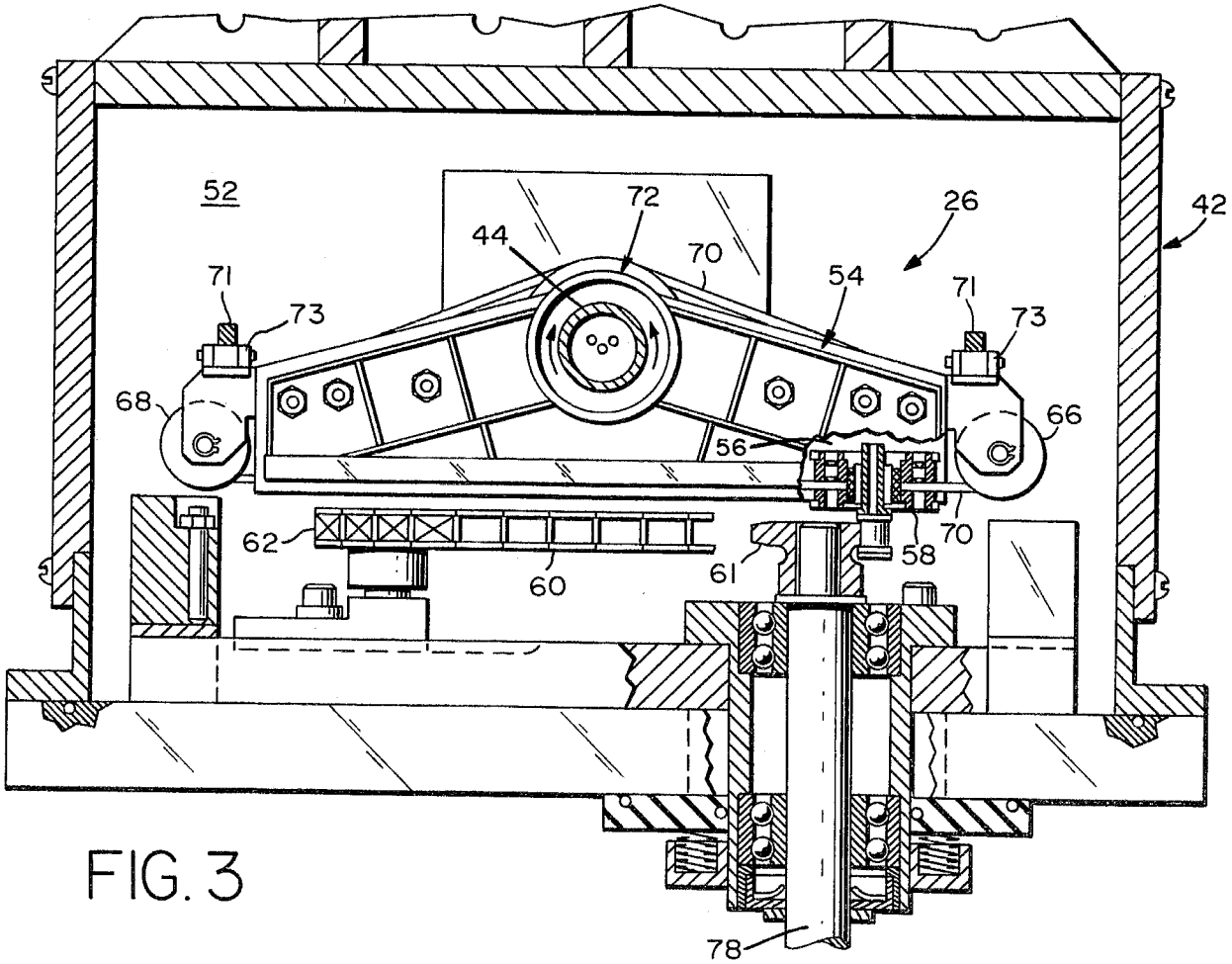
FIG. 3 is a front elevational view of the winding pattern generator, partially in section, taken along the line 3—3 of FIG. 1.
Figure 4:
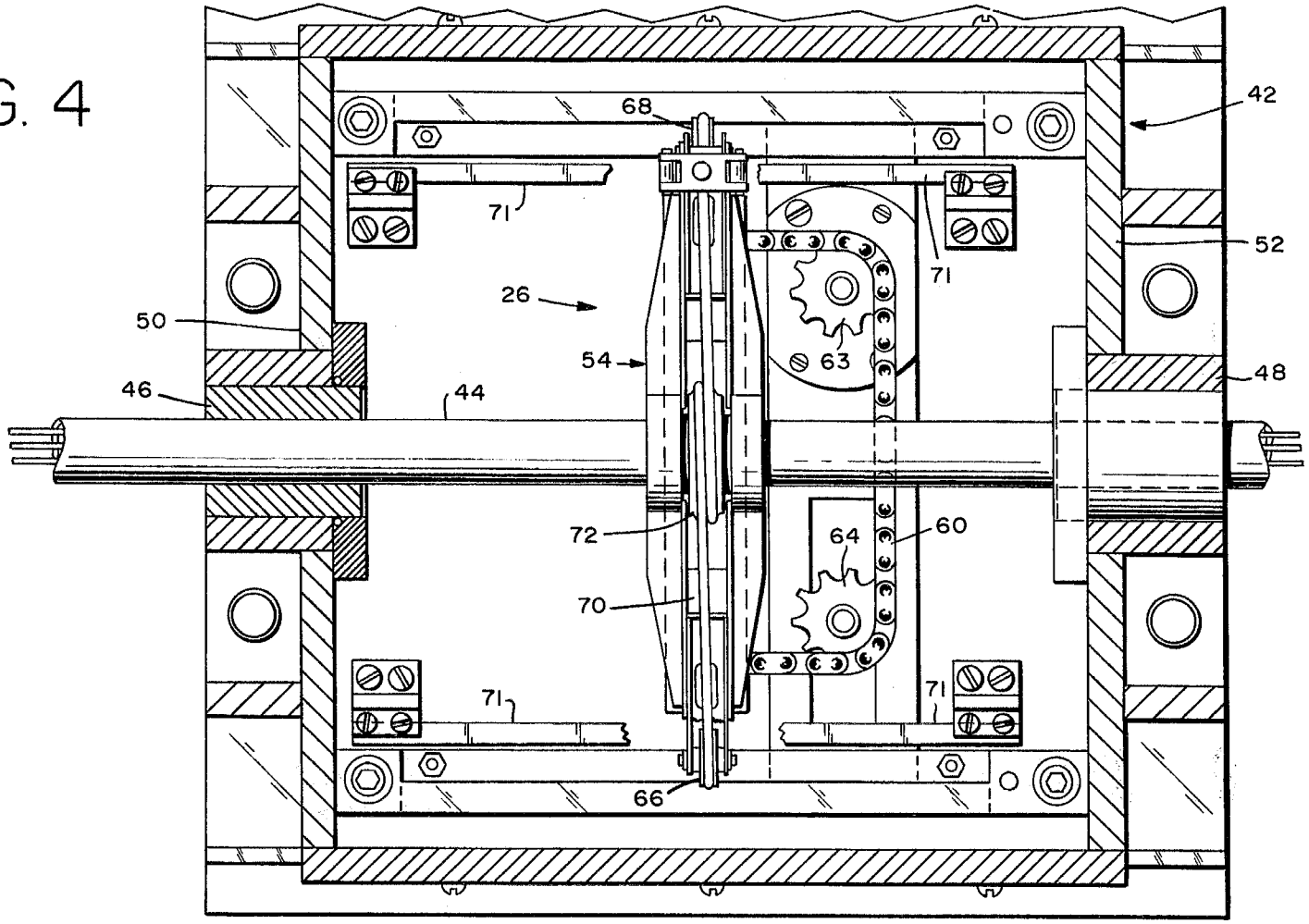
FIG. 4 is a plan view of the winding pattern generator.
Figure 5:
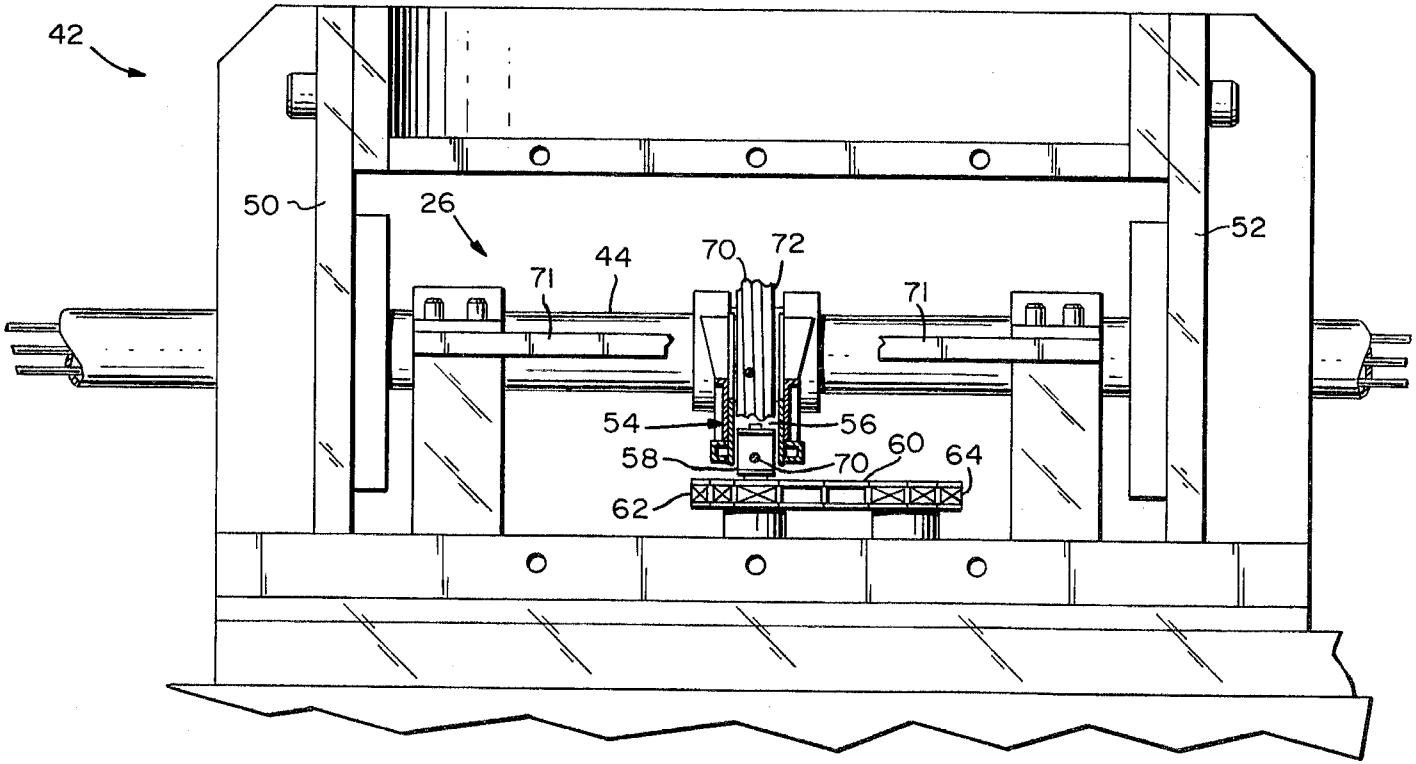
FIG. 5 is a side elevational view of the winding pattern generator.

Referring now to FIGS. 3, 4 and 5, the winding pattern generator is contained in the afore-mentioned housing 42 and comprises a hollow shaft 44 mounted to permit reciprocal longitudinal movement and arcuate or rotational movement, as by bearings 46 and 48 in end walls 50 and 52. A carriage 54 is mounted on shaft 44 in a manner to move reciprocally with shaft 44 while permitting the shaft 44 to rotate therewithin. Movement of carriage 54 is achieved by cooperation between a slideway 56 formed in the bottom of carriage 54 and a constrained slide 58 therein. Slide 58 is carried by a chain 60 which describes a substantially rectiliner path about a drive sprocket 61 and a plurality of idler sprockets 62, 63, 64. As shown, there are four sprockets defining a substantially rectangular path; however, it is to be understood that other configurations, such a trapezoidal, can be employed, the chain path configuration being determined by the shape of the coil being wound.

Carriage 54 is also provided with a pair of opposed idler pulleys 66, 68, mounted at the ends thereof. These pulleys carry a cable 70 which also passes around a threaded pulley 72 which is fixed to shaft 44. The ends of cable 70 are fixed in slide 58.

A pair of longitudinally extending guide bars 71 are parallel to shaft 44 and positioned over pulleys 66 and 68 respectively. A suitable roller 73 may ride against the underside of the bars 71. The bars 71 prevent warpage of carriage 54 from the torque applied by cable 70 during rotational movement of shaft 44.

All components are extremely lightweight to prevent destructive inertial forces.

Figure 19:
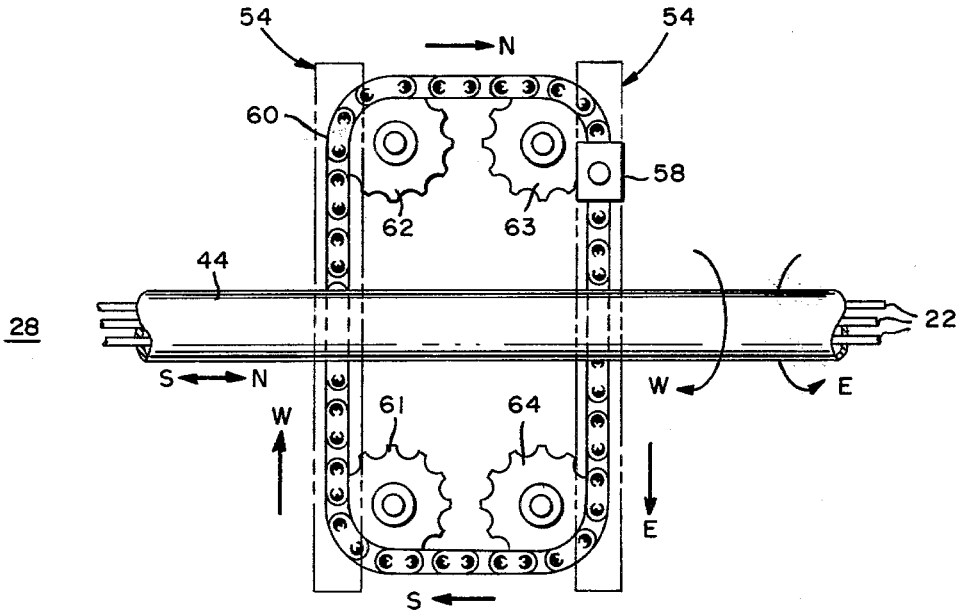
FIG. 19 is a diagrammatic plan view of the winding pattern generator.
Figure 18:
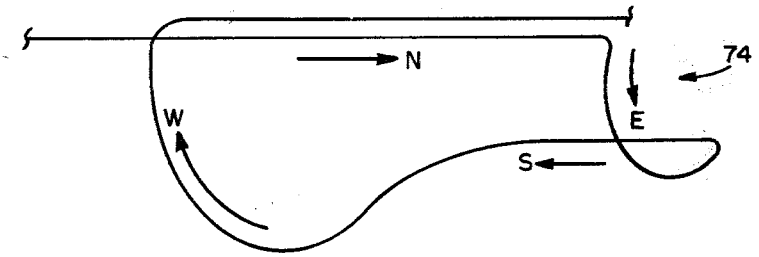
FIG. 18 is a diagrammatic perspective view of the coil being wound.

The movement of the winding pattern generator 26 and the resultant movement of winding head 28 can best be understood by reference to FIG. 19 which is a diagrammatic representation of generator 26, and FIG. 18 which is a diagrammatic representation of one turn of a saddle shaped coil 74.

Referring specifically to these latter FIGS., let it be assumed that slide 58 (which rides in slideway 56 in carriage 54) has a starting position at idler sprocket 63 and the first movement thereof is in the direction indicated as E. In this direction slide 58 is pulled through slideway 56 in carriage 54 and rotates shaft 44 in the rotational direction E by means of cable 70 and cooperating threaded pulley 72. This movement forms coil loop E of coil 74 as shown in FIG. 18. As slide 58 proceeds around idler sprocket 64 and in the direction indicated as S, slide 58 causes carriage 54 and thus shaft 44 to also move longitudinally in the S direction. This forms the longitudinal S segment of coil 74. As slide 58 rounds drive sprocket 61 and moves in the W direction it follows slideway 56 and rotates shaft 44 in the W rotational direction and forms coil loop W. After rounding sprocket 62, the slide 58 proceeds in the direction indicated as N, thus drawing carriage 54 and shaft 44 in the same direction and forming longitudinal coil segment N, as shown in FIG. 18. Slide 58 has thus returned to its starting position and the cycle is repeated as often as necessary to make the desired coil 74.

The wires forming coil 74 are drawn from supply 21 and extend thru the center of the hollow shaft 44 to the winding head 28. While three wires 22 are shown, this is by way of example only, since any number of wires may be simultaneously wound, depending upon the coil design and use.

Figure 6:
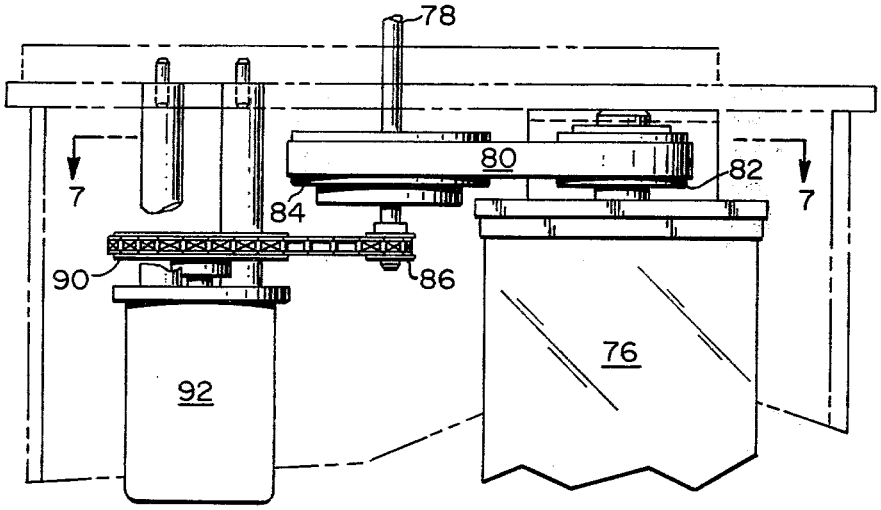
FIG. 6 is a side elevational view of the drive mechanism.
Figure 7:
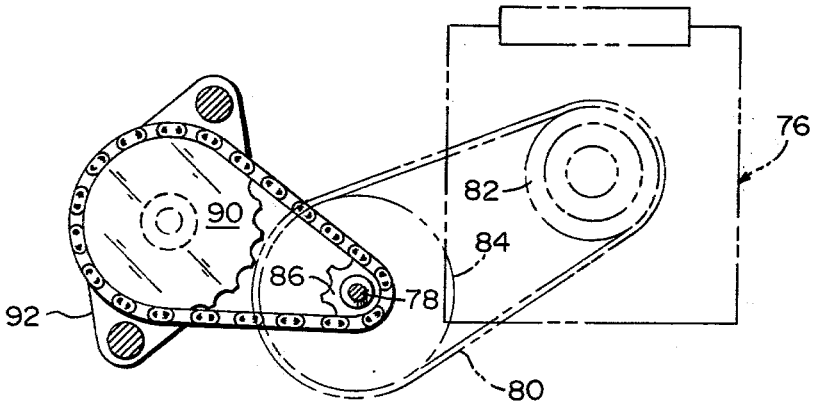
FIG. 7 is a plan view of the drive mechanism.

The winding pattern generator 26 is driven by driving means 29 (see FIGS. 6 and 7) which comprises a suitably mounted, high torque low inertia, digitally controlled motor 76. Motor 76 is connected to drive shaft 78 by a nonslipping means such as a toothed timing belt 80 and appropriate pulleys 82 and 84. One end of drive shaft 78 carries drive sprocket 61 and the opposite end is provided with an indentical sprocket 86. A chain 88 connects sprocket 86 to a sprocket 90 which drives a suitably mounted rotary switch 92. The rotary switch 92 is employed to monitor the position of winding head 28. To achieve this function it is necessary that sprocket 90 contains the same number of teeth as drive chain 60 has links, thus synchronizing the position of chain 60 and winding head 28. Preferably, the entire operation of apparatus 20 is electronically controlled through a programmable controller and electronic timing; however, mechanical control through cams, for example, would also work in place of winding pattern generator 26.

Figure 2:
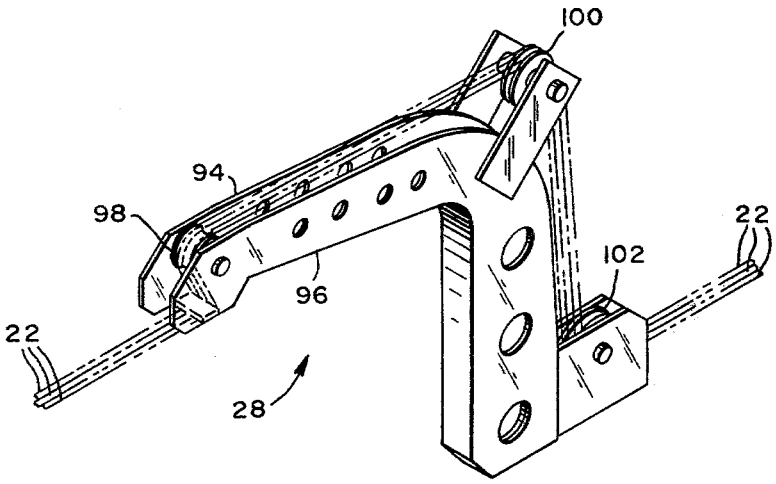
FIG. 2 is a perspective view of the winding head.
Figure 11:
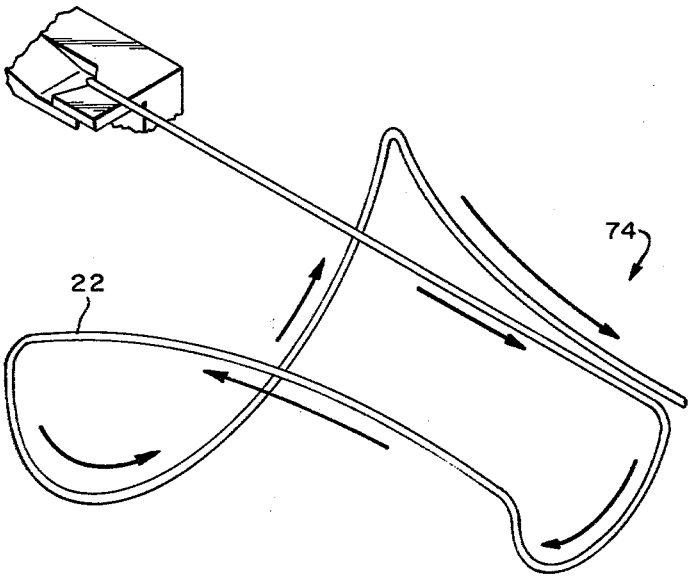
FIGS. 11–14 are perspective views illustrating the motions of the wire clamp and cutter.

The winding head 28 is fixed to one end of shaft 44 and thus moves longitudinally and rotatably as shaft 44 (which is moving in air bearings to minimize inertia) is moved by the winding pattern generator 26. FIG. 2 shows in detail one embodiment of a winding head 28 which comprises opposed sides 94 and 96 defining a space therebetween for pulleys 98, 100 and 102 for carrying one or more wires 22. Winding head 28 must have high strength and low mass (of the order of 40 grams) and thus is preferably constructed of aircraft steel.

Figure 8:
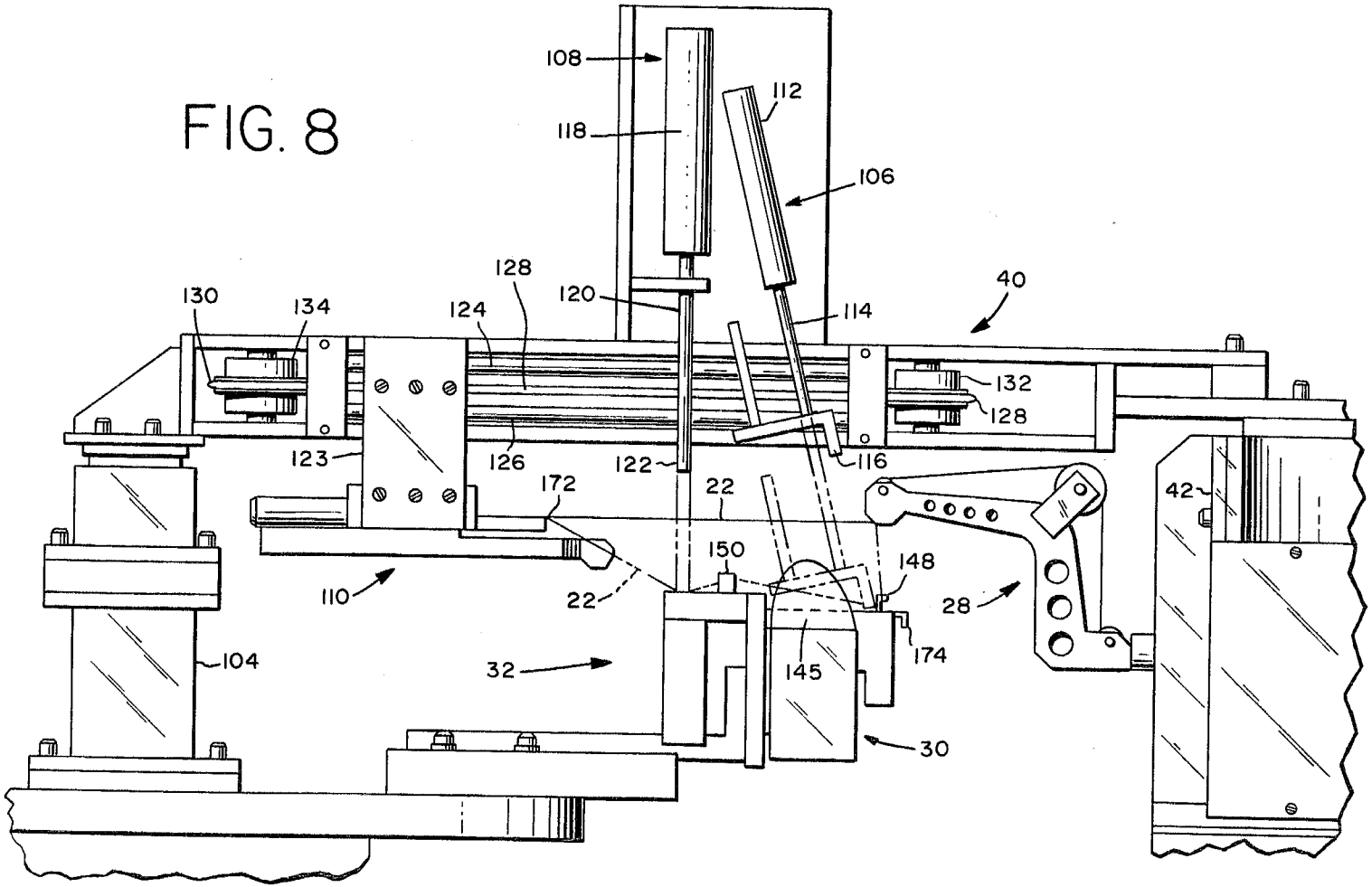
FIG. 8 is a partial side elevational view of the apparatus illustrating the wire clamping.
Figure 9:
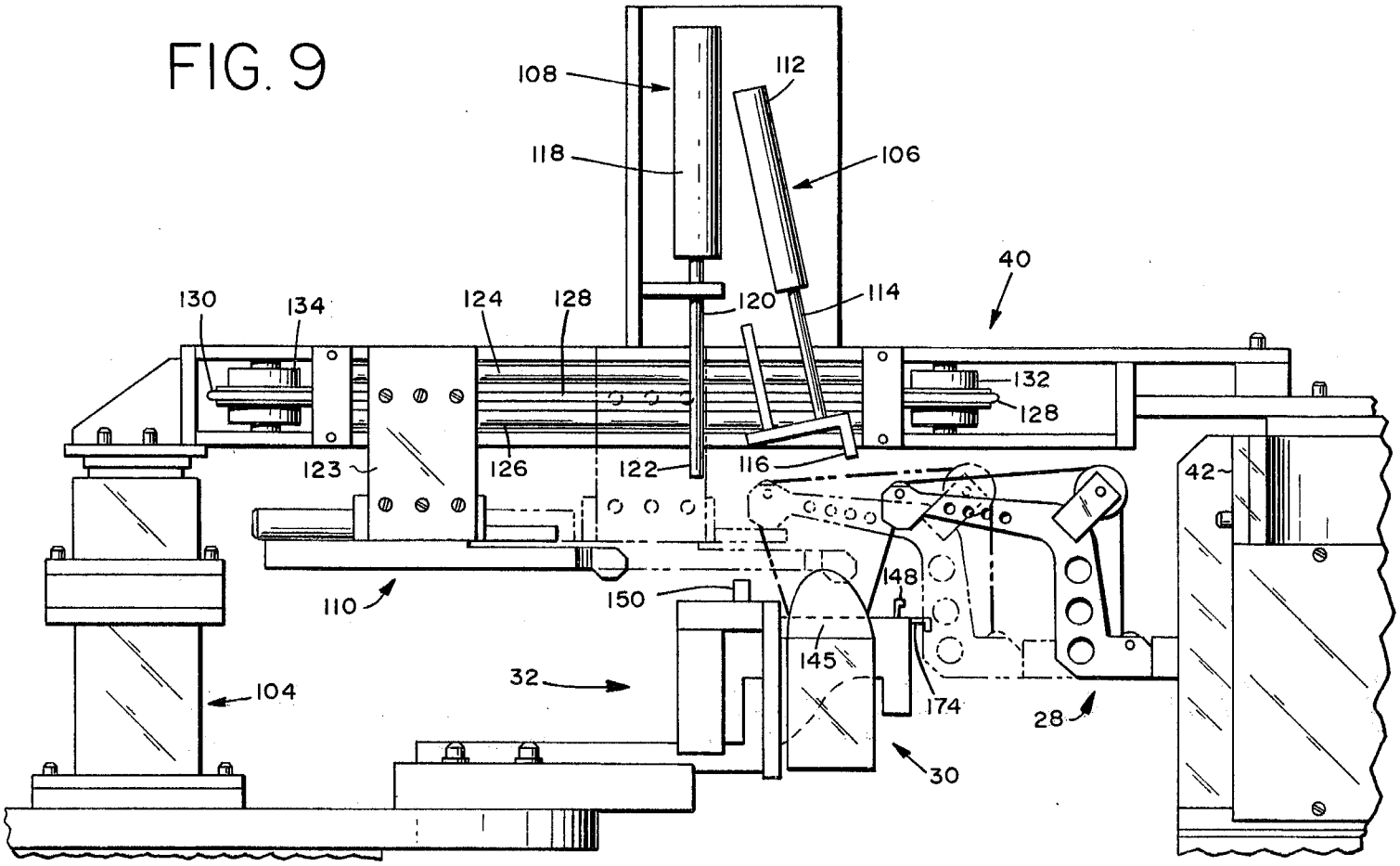
FIG. 9 is a partial side elevational view of the apparatus illustrating several positions of the winding head.

Referring now to FIGS. 8 and 9 there is shown therein the before-mentioned projecting bar 40. Bar 40 extends from housing 42 to a stationary member 104 on turret 34 and carries a first clamp 106, a second, intermediate clamp 108 and a threader or end clamp 110. Clamps 106 and 108 are mounted for movement in a direction substantially normal to wire 22 and clamp 110 is mounted for movement in a direction substantially parallel to wire 22. Clamp 106 comprises a fluid motor 112 having an extensible shaft 114 carrying on its exterior end a wire contacting arm 116.

Clamp 108 comprises a fluid motor 118 having an extensible shaft 120 having a wire contacting end 122. For both clamps 106 and 108, FIG. 8 depicts their at rest position in solid lines and their actuated position in phantom lines.

The threader or end clamp 110, which also provides a wire cutting function, is mounted for movement upon a support 123 which rides on parallel rods 124 and 126. Reciprocating movement of clamp 110 can be provided by a pair of cables 128 and 130 which each have one of their ends fixed in support 123 and their other ends fixed to opposite sides of a fluid motor piston, which is not shown. The cables revolve around fixed pulleys or rollers 132 and 134 respectively. The movement of clamp 110 is shown in phantom lines in FIG. 9.

Figure 12:
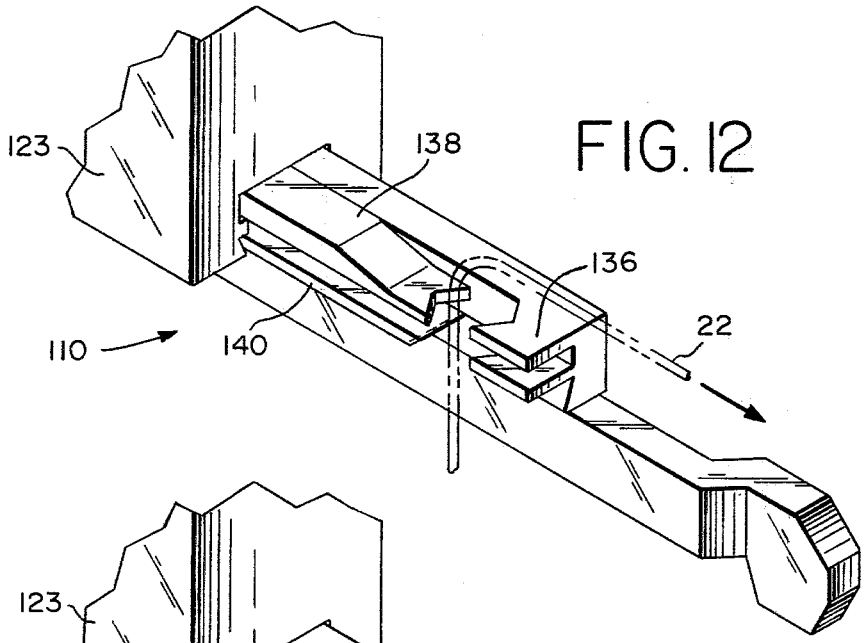
Figure 13:
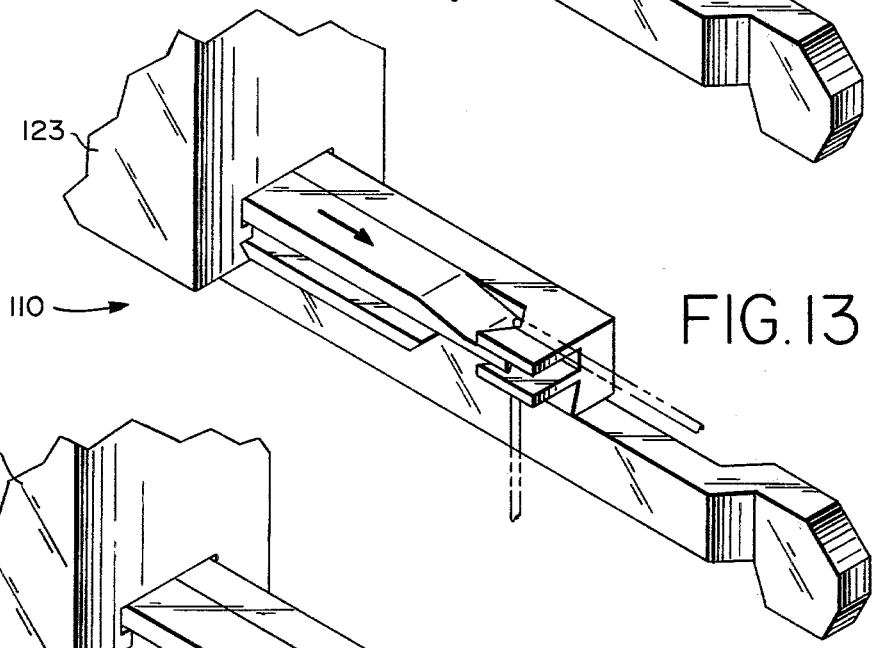
Figure 14:
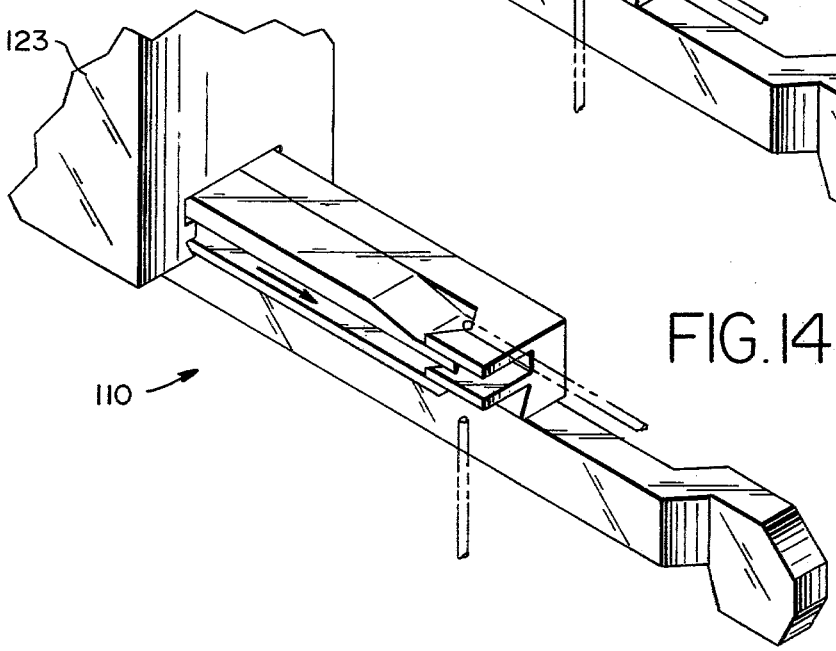

Referring now to FIGS. 12–14, clamp 110 is shown as further having a fixed, wire holding jaw 136 and a movable wire holding jaw 138 which cooperates therewith. Associated with the wire clamping jaws is a cutting blade 140 which cuts the wire 22 after it is clamped. Clamp 110 is actuated at the end of the winding cycle and severs the coil 74 from the supply 21, while holding the wire leading from the supply for the start of the next winding cycle.

Figure 10:
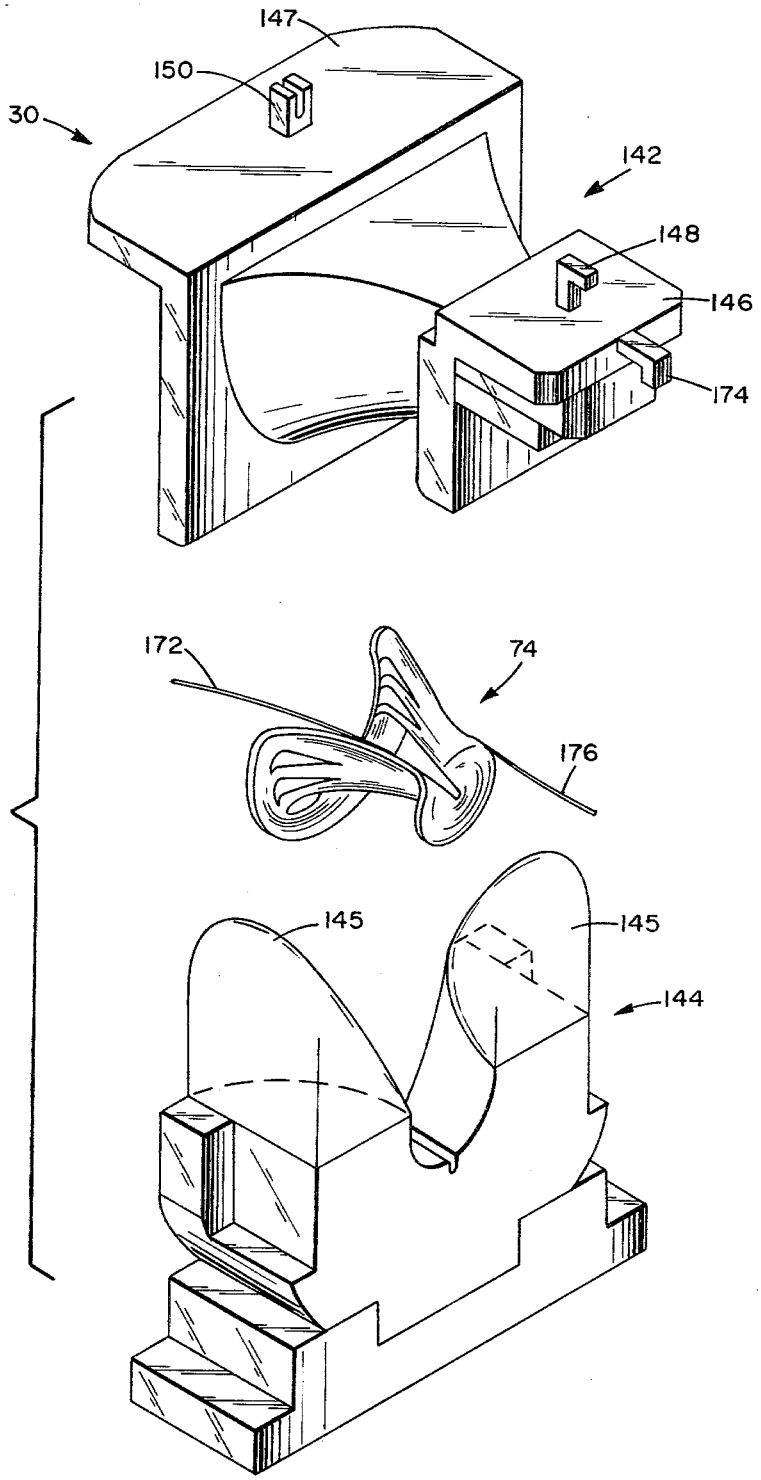
FIG. 10 is an exploded perspective view illustrating the coil and coil mould.

The yoke mould 30 is detailed in FIG. 10 and comprises a male portion 142 and a female portion 144. When mated together a cavity is defined between these portions where coil 74 is wound. A first surface 146 on male portion 142 carries a snubber 148 and a second surface 147 carries wire guide 150. Adjacent the opening defined in the female cavity 144 are substantially ellipsoidal wire guides 145.

Mounted upon the front side 152 of a support 154 for housing 42 is a wire tail former or pickup mechanism 156. The tail former 156 is thus positioned substantially beneath winding head 28. (See FIG. 1, and FIGS. 15–17).

Tail former 156 comprises a first fluid motor 158 vertically mounted to provide an up and down motion to a table 160 which carries a second fluid motor 162 whose axis of motion is transverse to that of fluid motor 158. Parallel guide rods 164 and 166 are fixed to table 160 and project downwardly therefrom, through suitable guide blocks 168 to maintain the horizontality of table 160 during its up and down movement.

Figure 15:
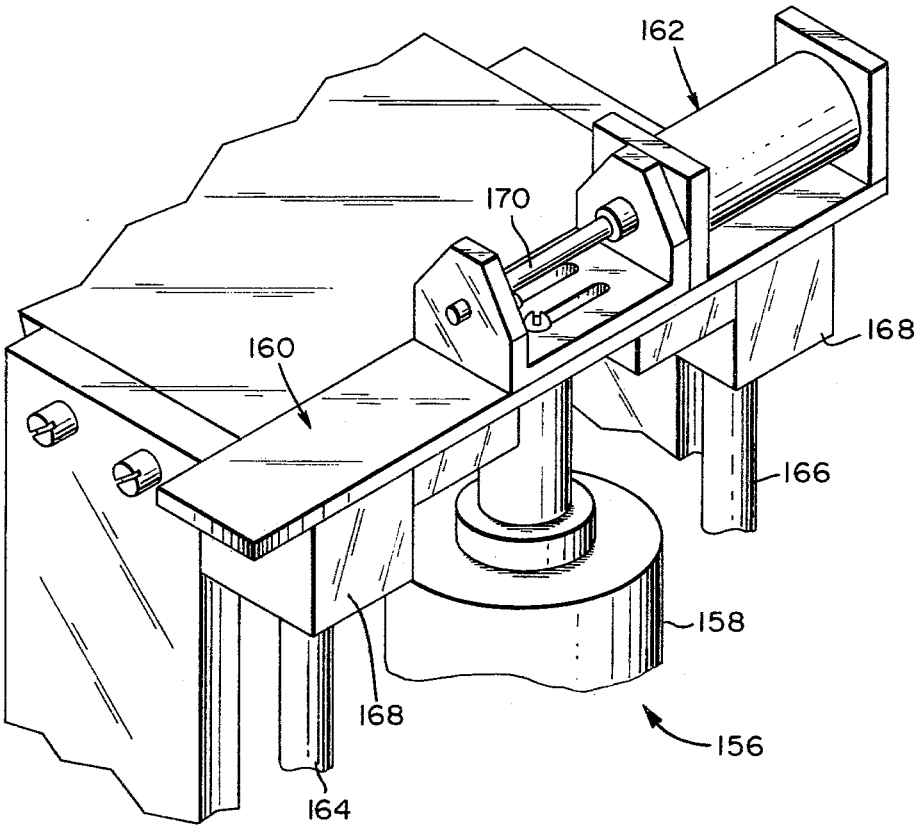
FIG. 15 is a partial perspective view illustrating the wire pick-up mechanism employed at the end of the winding operation.
Figure 16:
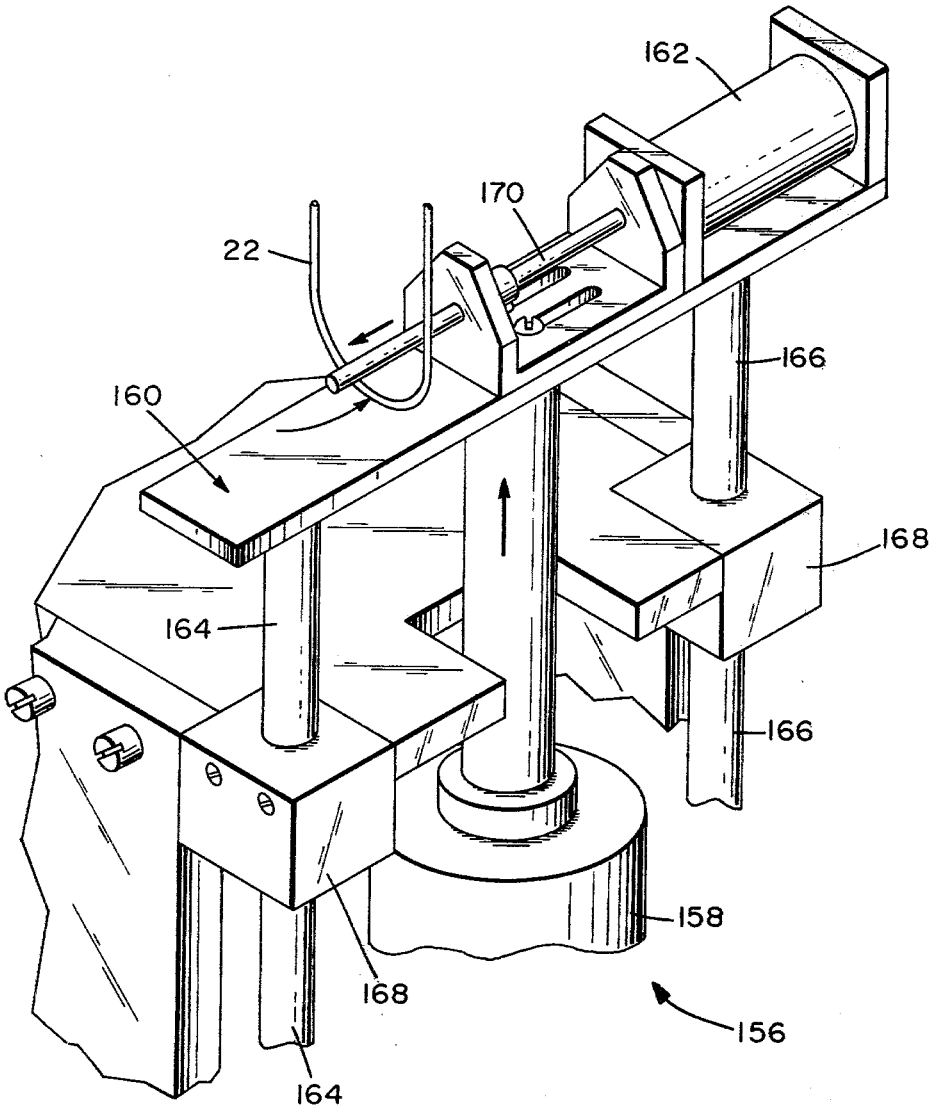
FIG. 16 is a view similar to FIG. 15 at a second position.
Figure 17:
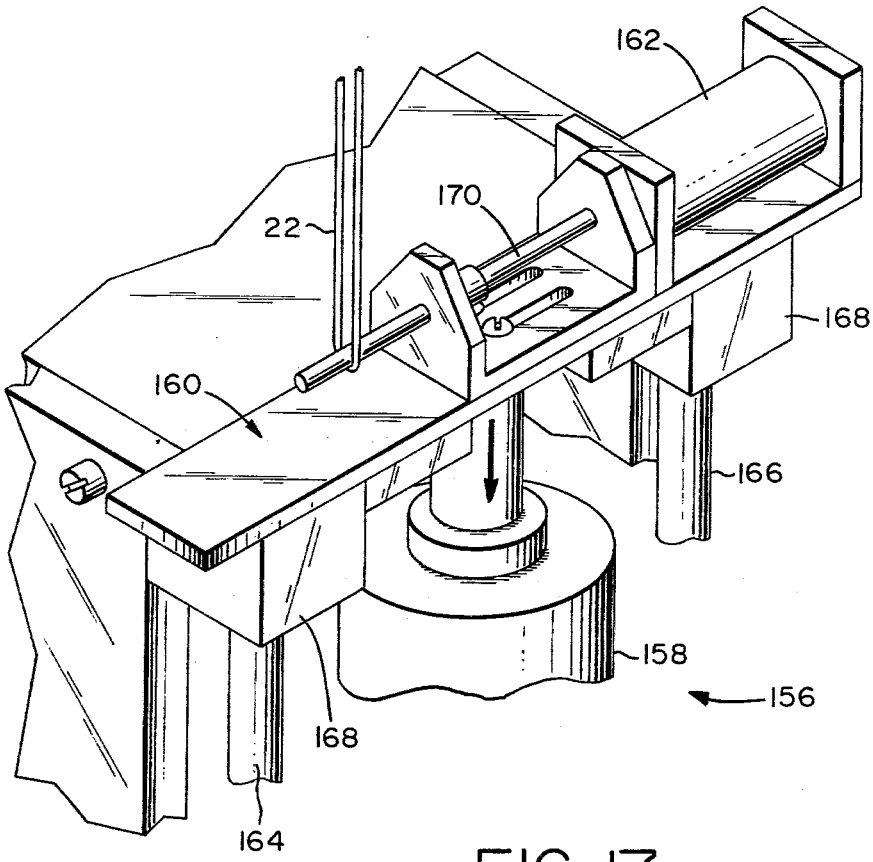
FIG. 17 is a view similar to FIG. 16 at yet a later position.

Fluid motor 162 carries an extensible piston shaft 170 which, when extended engages a loop of wire 22 as will be explained hereinafter. FIG. 15 shows the tail former 156 in its at rest position; FIG. 16 in its raised position with shaft 170 extended and engaging a loop of wire 22; and FIG. 17 at its returned position.

For a clearer understanding of the invention a sequence of a complete cycle of operation will be described.

At the beginning of a coil winding operation a first terminal end 172 of a wire (or wires) 22 is held in threader or end clamp 110 and a coil mould 30 is indexed into position at the winding station 32. This position is shown in FIG. 8 with wire 22 as a solid line. First clamp 106 is actuated, and wire contacting arm 116 pins wire 22 to mould 30 adjacent snubber 148 (as shown in phantom lines). Winding head 28 is actuated for a slow turn in the E direction, which feeds wire 22 around snubber 148 and snubs the wire. Fast winding then begins and is controlled by the action of the winding pattern generator 26 as hereinbefore described. Before the winding is completed, second, intermediate clamp 108 is actuated and wire contacting end 122 of shaft 120 contacts wire 22 and carries it into wire guide 150. This action also pulls terminal end 172 of wire 22 from clamp 110. Subsequently, clamp 106 is released to return to its starting position.

At the end of the winding cycle the tail former 156 is employed. Fluid motor 156 is actuated which raises table 160 to an appropriate height. Clamp 110 is actuated and moves toward winding head 28. Fluid motor 162 is actuated causing shaft 170 to extend and engage wire 22 (FIG. 16).

Fluid motor 158 is deactivated and returns to its starting position drawing wire 22, which is around shaft 170 with it. Substantially simultaneously, winding head 28 is activated, in reverse, for a single arcuate movement which is opposite to turn E of the coil. This engages wire 22 about a second snubber 174 (see FIG. 10) and also lays the wire 22 into jaw 136 of clamp 110. The cutting and clamping jaws of clamp 110 are activated, simultaneously cutting and releasing the tail 176 of coil 74 and forming and holding a new terminal end 172 for the start of the next cycle. Clamp 110 is then retracted to its starting position, carrying wire 22 with it. Shaft 170 can be retracted anytime after table 160 returns to its starting position, since its operation is to provide the necessary length of unwound wire to be used for subsequent testing and ultimate connections of the formed coil 74.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The employment of this invention is advantageous in the manufacture of deflection yokes for cathode ray tubes.

We claim:

1. An apparatus for winding saddle shaped coils containing multiple turns of at least one strand of wire and having front and rear arcuate lobes connected by substantially longitudinal portions comprising:

a supply of wire;

a winding head to which wire from said supply is fed;

a wire tensioning device positioned between said winding head and said supply;

a winding pattern generator operatively connected to said winding head positioned between said winding head and said tensioning device;

driving means for said winding pattern generator comprising a high torque, low inertia, digitally driven motor; and a coil mould indexable into and out of position at a winding station operatively functional with said winding head said winding head comprising means for moving said winding head in sequential arcuate and longitudinal movements to form said coil in said mould, said last named means comprising:

a hollow, substantially longitudinally extending shaft having said winding head affixed at one end thereof, said shaft being mounted to permit reciprocal longitudinal movement and arcuate movement, said at least one strand of wire being fed through said hollow shaft; a carriage mounted on said shaft in a manner to move reciprocally with said shaft while permitting said shaft arcuate movement, and motion providing means operatively connected to said carriage; said motion providing means comprises a driven chain and a plurality of cooperating sprockets so spaced as to define a path for said chain; one link of said chain carrying a slide which cooperates with a slideway in said carriage; said carriage having opposed idler pulleys at the ends thereof; said shaft having a threaded pulley mounted thereon to cause rotation of said shaft; and a cable passing over said idler pulleys and said threaded pulley, the ends of said cable being fixed in said slide, whereby chain caused movement of said slide in a direction transverse to said slideway causes longitudinal movement of said shaft, and chain caused movement of said slide in a direction along said slideway causes rotational movement of said shaft thru the medium of said cable and pulleys.

* * * * *